US007240589B2

(12) United States Patent
Kehoe

(10) Patent No.: US 7,240,589 B2
(45) Date of Patent: Jul. 10, 2007

(54) BEVERAGE CONTAINER OPENER

(76) Inventor: Daniel P. Kehoe, 59 Teresa Drive, Whitby, Ontario (CA) L1N 6H9

( * ) Notice: Subject to any disclaimer, the term of this patent is extended or adjusted under 35 U.S.C. 154(b) by 0 days.

(21) Appl. No.: 11/374,174

(22) Filed: Mar. 14, 2006

(65) Prior Publication Data

US 2006/0207390 A1 Sep. 21, 2006

Related U.S. Application Data

(60) Provisional application No. 60/661,499, filed on Mar. 15, 2005.

(51) Int. Cl.
*B67B 7/44* (2006.01)
*B67B 7/18* (2006.01)
*B67B 7/00* (2006.01)

(52) U.S. Cl. ..... 81/3.09; 81/3.4

(58) Field of Classification Search ..... 81/3.09, 81/3.4, 3.42; D8/40, 43
See application file for complete search history.

(56) References Cited

U.S. PATENT DOCUMENTS

| | | | | | |
|---|---|---|---|---|---|
| 736,455 | A * | 8/1903 | Stork | 81/3.42 |
| 1,638,185 | A * | 8/1927 | Craig | 7/152 |
| 2,458,806 | A * | 1/1949 | Tippett | 81/3.56 |
| 2,589,051 | A * | 3/1952 | Carter | 81/3.42 |
| 2,625,847 | A * | 1/1953 | Frazier | 81/3.56 |
| 2,698,549 | A * | 1/1955 | Campbell | 81/3.42 |
| 3,604,289 | A * | 9/1971 | Steel | 81/3.42 |
| 4,052,917 | A * | 10/1977 | Gee | 81/3.42 |
| 4,306,470 | A * | 12/1981 | Woloszyn | 81/3.42 |
| 4,507,988 | A * | 4/1985 | LoFaso et al. | 81/3.09 |
| 4,846,024 | A * | 7/1989 | Bryant et al. | 81/3.09 |
| 4,911,038 | A * | 3/1990 | Ferrin | 81/3.09 |
| 4,967,622 | A * | 11/1990 | Phillips | 81/3.09 |
| 4,995,295 | A * | 2/1991 | Floyd | 81/3.44 |
| 5,253,552 | A * | 10/1993 | Brand et al. | 81/3.42 |
| D350,264 | S * | 9/1994 | Friend | D8/43 |
| 5,365,806 | A * | 11/1994 | Paramest | 81/3.09 |
| 6,854,361 | B2 * | 2/2005 | Vandergaw | 81/3.4 |
| 7,004,049 | B2 * | 2/2006 | So et al. | 81/3.09 |
| 2003/0150296 | A1 * | 8/2003 | Vandergaw | 81/3.4 |
| 2005/0044995 | A1 * | 3/2005 | Bathey | 81/60 |
| 2005/0183547 | A1 * | 8/2005 | Corredor et al. | 81/3.09 |
| 2005/0252343 | A1 * | 11/2005 | Turner | 81/3.09 |

FOREIGN PATENT DOCUMENTS

| | | | |
|---|---|---|---|
| DE | 3306741 | A1 * | 8/1984 |
| EP | 246023 | A1 * | 11/1987 |
| FR | 2670767 | A1 * | 6/1992 |
| GB | 2170789 | A * | 8/1986 |

* cited by examiner

*Primary Examiner*—David B. Thomas

(57) ABSTRACT

A beverage container opener which includes a housing having a holding surface and a first operational part is disclosed. The operational part includes a first gripping member for engaging at least a first portion of a circumference of a bottle cap and a second gripping member for engaging a different second circumferential portion of the bottle cap. A slider is actuable by the user from at least the holding surface to effect relative movement between the first and second gripping member towards each other to engage the circumference of the bottle cap therebetween. The rotation of the housing while the first and second gripping members engage the bottle cap, thereby facilitating rotation of the bottle cap by providing greater torque forces thereon.

17 Claims, 8 Drawing Sheets

BEVERAGE CONTAINER OPENER

RELATED APPLICATIONS

This application claims the benefit under 35 U.S.C. 119(e) to U.S. provisional application Ser. No. 60/661,499 filed 15 Mar. 2005, entitled Container Opening Device.

FIELD OF THE INVENTION

The present invention relates to a device for opening containers. In particular, the present invention relates to a manual device for facilitating the opening of various types of beverage containers including rotational bottle caps, metal crimped bottle caps and cans having tabs.

BACKGROUND OF THE INVENTION

In the past, various types of bottle openers and container openers have been proposed. However, the prior art devices have suffered from several disadvantages.

In several cases, difficulty has arisen in grasping the cap of a bottle. This is the case particularly if the cap to the bottle is relatively small, requiring the user to grasp the bottle cap tightly in a small area and to cause rotation of the cap about a very small circle. This has been difficult particularly for young children or older people who do not generally have the dexterity or strength in their hands and fingers to grasp the bottle cap and also rotate it quickly.

In other opener constructions with use with can lift tabs, it has been found that current can tab lifter devices in the prior art use two contact points to raise the tab and open the beverage can. This is shown, for instance, in FIG. 10 which shows contact points A and B of an opening tab used on a conventional beverage can. Contact point A is the weakest point of the lift tab and point B is formed as an engageable end which pivots about a fulcrum into bearing contact with a partially detachable portion of the can lid. In use, the user is required to apply a downward force on the lifter device at the same time as the force applied to open the can in order to avoid damaging the can tab. The tab on a beverage can has a strong area and a weaker area. If, however, the tab breaks or bends, it typically breaks or bends at mid-points C and D as shown in FIG. 12. This can cause substantial difficulties in thereafter opening the can, if it can be opened at all.

SUMMARY OF THE INVENTION

Accordingly, it is an object of this invention to at least partially overcome the disadvantages of the prior art by providing an improved manual bottle opener which is adapted to facilitate the opening of a number of different types of beverage containers, including twist cap bottles, cans having lift tabs, and other types of metal crown or pry top bottles.

Another object of the invention is to provide a lightweight beverage container opener which is easily manufactured and economical to produce.

Another object of the invention is to provide a universal container opener which has multiple operational parts or components which are engagable to open different types of cans or bottles, and which is sized and contoured for ease of holding and manipulation by a user to facilitate use of the device.

In one preferred construction, the opening device is provided with a housing which is sized to be gripped and held by a user. The housing is provided with an upper holding surface and a bottom side surface. One or more operational parts are provided in the housing for use in engaging and actuating twist caps, tab pulls and/or pry caps. Most preferably, a first operational part is formed in the housing lower surface. When gripping the holding side, the bottom side may thus be moved to thereby engage a bottle cap of a bottle. The housing, which is preferably larger than the bottle cap in size and may be oblong or longitudinally elongated along an axis to facilitate grasping, can then be rotated to open or close the bottle cap.

In use of the opener in opening a conventional beverage can, a nosing or forward end portion of the device may be used to engage a can lift tab. Once so engaged the housing may be pivoted relative to the can to apply the necessary lift forces by engaging the left and right sides of the strongest part of the can tab. This advantageously eliminates the risk of bending the tab.

The present invention provides a device for opening containers which in a simplified construction includes a housing having a holding surface and a first operational part. The operational part includes a first gripping member for engaging at least a first portion of a circumference of a bottle cap and a second gripping member for engaging a different second circumferential portion of the bottle cap. A slider or other relative movement mechanism is preferably actuable by the user from at least the holding surface to effect relative movement between the first and second gripping members towards each other to engage the circumference of the bottle cap there between. The rotation of the housing, while the first and second gripping members engage the bottle cap, facilitate rotation of the bottle cap by providing greater torque forces thereon.

The relative movement mechanism causes relative movement between the first gripping member and the second gripping member to engage the circumference C of the bottle cap therebetween. In this way, once the opener is placed on top of the bottle cap actuation of the relative movement mechanism by the user will cause relative movement between the first gripping member and the second gripping member to engage the circumference C of the bottle cap 1 therebetween, facilitating rotation of the bottle cap by rotating the opener housing.

In one aspect, the present invention resides in a universal opener for opening twist cap and pull tab beverage containers, said opener comprising, a housing having an upper surface contoured for gripping by a user's hand, and a lower surface, the housing extending in an axial direction from a generally tapered forward end portion to distal rearward end portion, a first operation part being disposed at said forward end portion, the first operation part including, a rearwardly extending slot extending inwardly into said housing a distance of at least about 3 mm, the slot having a lateral dimension selected between about 1 and 3 cm and being sized to engagably receive an end portion of a beverage container pry tab therein, a second operational part being disposed towards said rearward end portion, the second operational part including, a recess formed in said lower surface, a pair of gripping members at least partially disposed in said recess, a first one of said gripping members being fixedly secured to said housing, the second other one of said gripping members being configured for movement relative to said first gripping member between a first position remote from said first gripping member and a second position spaced a distance theretowards, said recess having a dimension selected to receive a portion of a beverage container twist cap therein in a position interposed between said first and second gripping members, when said gripping members are in said first position.

In another aspect the present invention resides in an opener for opening twist cap and pry tab containers, said opener comprising, a housing having an upper surface sized and contoured for gripping by a user's hand, and a lower surface, the housing being elongated in an axial direction and extending from a forward-end portion to distal rearward end portion, a first operation part being disposed towards said forward end portion, the first operation part including, a slot extending rearwardly into said housing and being sized to engagably receive a pivotal end portion of a container pry tab therein, a second operational part being disposed towards said rearward end portion, the second operational part including, a recess formed in said lower surface, a pair of gripping members at least partially disposed in said recess, a first one of said gripping members being coupled to said housing, the second other one of said gripping members being configured for movement relative to said first gripping member between a first position remote from said first gripping member and a second position spaced a distance theretowards, each of said gripping members including a toothed-blade positioned for engagement with a peripheral portion of a twist cap interposed therebetween when said second gripping member is moved to said second position, a biasing member for resiliently biasing the second gripping member to the first position.

In a further aspect the present invention resides in a device for opening beverage containers comprising; a housing having a holding side and a first operational side; a first gripping member for engaging at least a first portion of a circumference of a bottle cap; a second gripping member for engaging a second portion of the circumference of the bottle cap, different from the first portion; relative movement mechanism actuable by the user from the holding side for causing relative movement between the first grip and the second grip to engage the circumference of the bottle cap therebetween; wherein rotaton of the housing while the first grip and the second grip are engaging the first and second portion of the bottle cap, respecrtively, facilitates rotation of the bottle cap.

Preferably, at least one gripping member is provided on the sliding mechanism. A biasing device is further included in engagement with the sliding mechanism. The biasing device may simply comprise a spring located within the housing. Preferably, the biasing device will bias the second moveable blade away from the first moveable blade. This will facilitate the insertion of the bottle cap between the first and second blade prior to movement of the sliding mechanism.

In yet another aspect, the present invention provides a device for removing, loosening, replacing or otherwise tightening the cap from a bottle type container which includes: device with a fixed grip and a moving grip; (a) the device could consist of one or two moving grips; (b) the device could consist of another moving grip instead of a fixed grip; (c) the device could consist of a multi-part fixed grip; and although not essential (d) the teeth on the moving grip are most preferably in the opposite direction than the fixed grip.

BRIEF DESCRIPTION OF THE DRAWINGS

Further aspects of the invention will become apparent upon reading the following detailed description, taken together with the accompanying drawings in which.

DETAILED DESCRIPTION OF THE PREFERRED EMBODIMENTS

Preferred embodiments of the invention and its advantages can be understood by referring to the present drawings. In the present drawings, like numerals are used for like and corresponding parts of the accompanying drawings.

Figure 1:
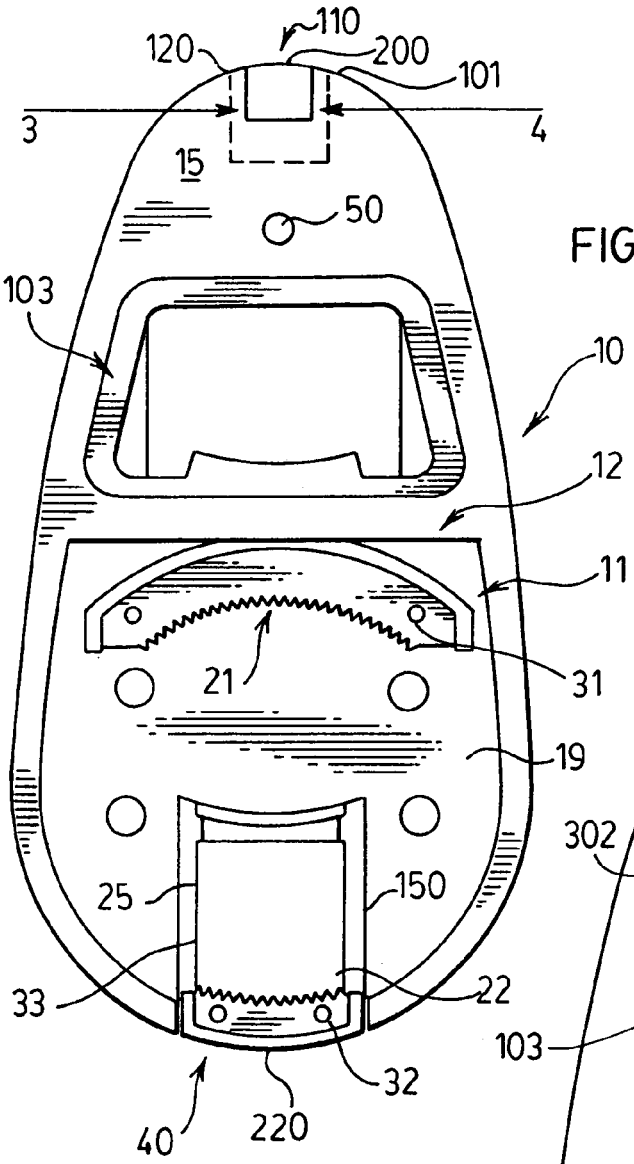
FIG. 1 illustrates a bottom view of a beverage container opener in accordance with a preferred embodiment of the invention.
Figure 2:
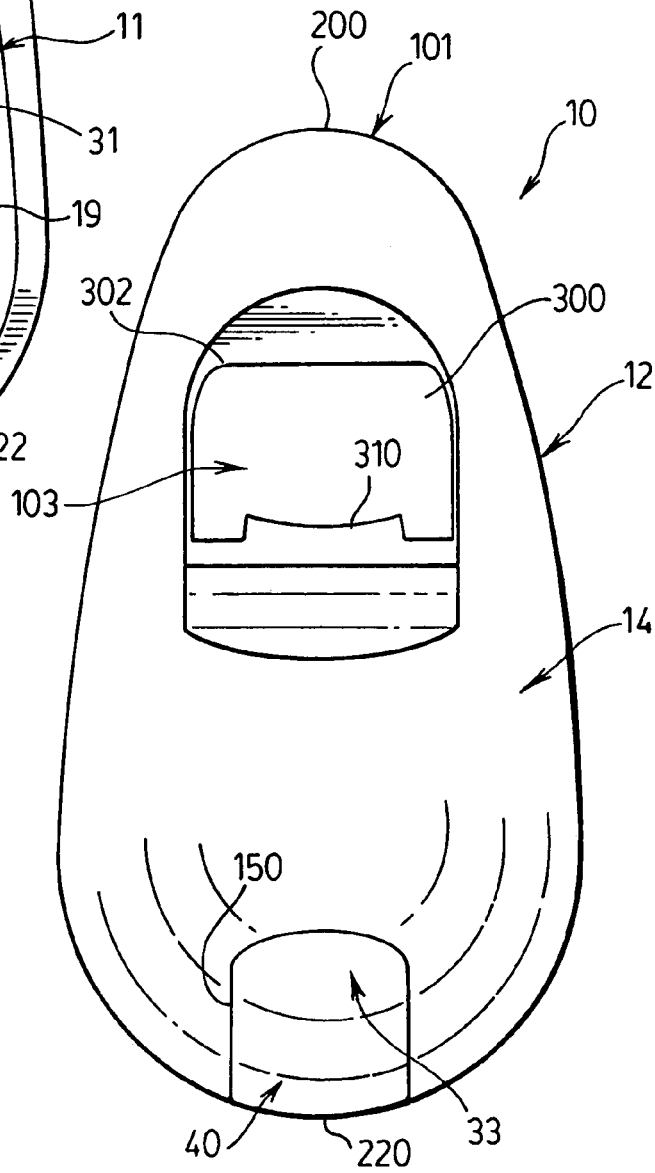
FIG. 2 illustrates the top view of the opener shown in FIG. 1.
Figure 3:
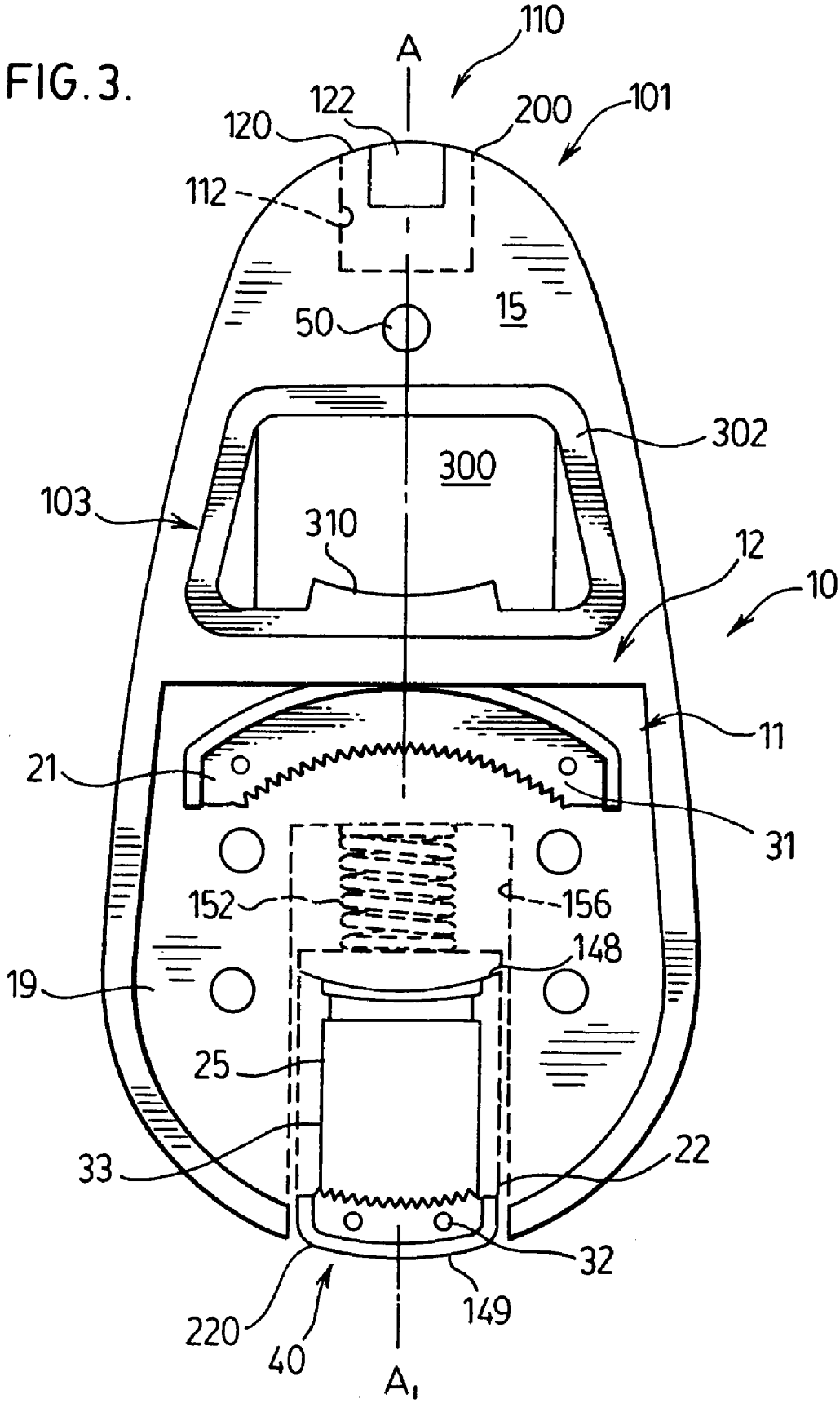
FIG. 3 illustrates schematically the bottom view of the opener of FIG. 1 illustrating a tab engaging slot and a slider slot formed therein.

Reference is first made to FIGS. 1 to 3 which illustrate a beverage container opener 10 in accordance with a preferred embodiment of the invention. As will be described, in a preferred embodiment, the opener 10 is provided with a generally tear shaped housing 12 which tapers outwardly from a rounded narrow nose portion 200 to an enlarged end portion 220 remote therefrom. The housing 12 is sized to enable the opener 10 to be comfortably gripped by a user's hand and preferably has an enlarged length in the direction of axis $A–A_1$ selected at between about 8 and 15 cm, and more preferably about 10 cm. The lateral width of the housing is preferably selected at about 2 to 3 cm at the nose portion 200, extending outwardly to about 3 to 5 cm at the enlarged end portion 220.

The housing 12 has an upper holding side, shown in FIG. 2 by reference numeral 14 and a generally planar or flat lower side 15. The housing 12 is further delineated into three separate operational portions 11, 101, and 103. As will be described, in use of the opener 10 the operational portions 11, 101 and 103 may be used to facilitate the opening of different types of beverage containers, including without restriction pry top bottles such as beer bottles twist cap bottles such as water or plastic soft drink bottles, as well as canned beverage containers, such as beer and pop cans.

Figure 4:
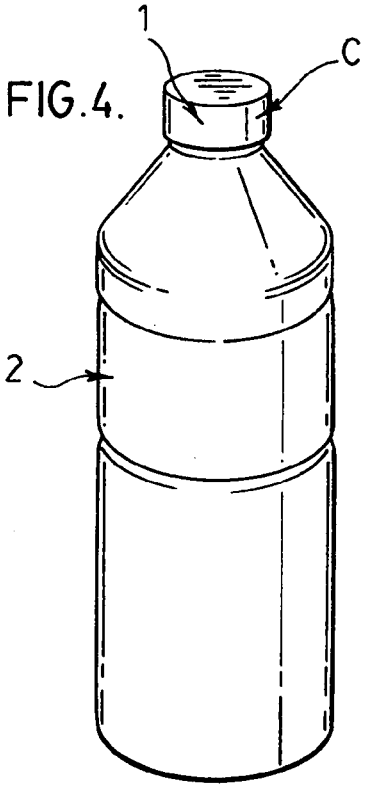
FIG. 4 illustrates a conventional plastic bottle having a twist-off type cap.

FIGS. 1 and 3 illustrate best the first operational portion 11 which in use of the opener 10, facilitates the opening and/or tightening of twist caps. The first operational portion includes a 3 to 5 mm deep recess 19 (FIG. 3) formed in the lower side 15 of the housing 12, adjacent to the enlarged end portion 220. A pair of gripping members 21,22 are provided within the recess 19, and which in use, are selectively actuable to engage the side portions of the twist off cap (shown as 1 in FIG. 4), coupling the opener 10 thereto. The first of the gripping member 21 is permanently secured to the housing 12 adjacent to a forwardmost end of the recess 19 spaced proximate most towards the nose portion 200. The gripping member 21 includes a metal blade 31. The blade 31 is provided with a shark-tooth profile and is marginally concave with its teeth oriented towards the end 220.

As shown best in FIGS. 2 and 3, the gripping member 22 includes a slider 148 which is movable relative to a remainder of the housing 12. The slider 148 includes a rearwardmost depending flange 149 which projects downwardly to define a portion of the recess 19. An axially aligned slot 150 is formed through the housing 12 inwardly from the enlarged end 220 towards the nosing end 200. A metal blade 32 is mounted to the slider flange 149 for movement with the slider 148 towards the blade 31. Like the blade 31, the blade 32 has a generally shark-tooth profile and is formed with an arcuate curvature which is slightly concave in the direction of the nosing end 200. A compressible helical spring 152 (FIG. 3) is positioned within a cavity 156 formed in of the housing 12 so as to resiliently bias the slider 148 to an undeployed position shown in FIG. 3, wherein the blade 32 is moved to a distalmost position remote from the blade 31.

Figure 5:
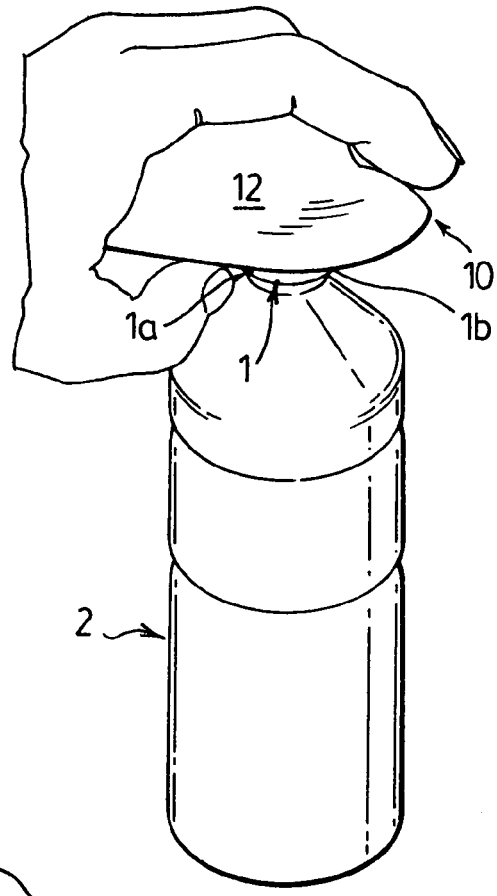
FIG. 5 illustrates a perspective view of the opener of FIG. 1 in use in the removal of the twist-off cap shown in FIG. 4.

It is understood that the gripping member 21, 22 and the blades 31, 32 thereon have a circumference which is generally selected to facilitate engaging the circumference of a variety of sizes of twist caps 1 (FIG. 4) for bottles 2 and the like. Furthermore, the teeth of the blades 31,32 are preferably designed to be on an angle, as shown in FIG. 1, in order to engage the ridges on a bottle cap, (by reference numerals 1 and 15 in FIG. 5) on the bottle 2, so as to grip the bottle cap 1 in a direction of its helical threads in order to open the bottle cap. Preferably, the first gripping member 21 is positioned to engage at least a first portion 1*a* of a circumference C of the bottle cap 1 and the second gripping member 22 will engage at least a second radially opposing portion 1*b* of the circumference C of the bottle cap 1. It is also understood that having two gripping members 21, 22 is merely an aspect of a preferred embodiment of the present invention. It is understood that the opener 10 may comprise a third grouping member (not shown) or additional gripping elements (not shown) so as to engage two or more portions of the circumference C of the bottle cap 1. It is also understood that having additional gripping elements (not shown) could facilitate opening bottle caps 1 having different circumferences even if not all of the two gripping elements 21, 22 or additional gripping elements (not shown) engage the cap 1.

Although not essential, most preferably the slot 150 is formed through upper holding side 14 of the housing 12 extending inwardly from the end portion 220 a distance of between 1 and 3 cm. The slot 150 has a width selected to permit substantially unhindered movement of the user's finger therealong as the slider 148 is moved against the bias of the spring 152 axially towards the griping member 21 so as to engage the circumference C of the bottle cap 1 there between. In this way, bottle caps 1 of various sizes may be accommodated between the first gripping member 21 and the second gripping member 22. It is also understood that the first gripping member 21 and the second gripping member 22 should preferably be on opposite sides of the recess 19 and facing each other. If more than two gripping members 21, 22 are used, alternate arrangements may be possible.

Furthermore, it is also apparent that the first gripping member 21 need not be the same size as the second gripping member 22. Moreover, the circumference of the first blade 31 may be different in the circumference of the second blade 32 in order to facilitate grasping first and second portions 1*a* and 1*b* of different sizes of bottle caps 1.

The gripping member 21 and second gripping member 22 are movable relative to each other, such that the blades 31,32 engage and contact the sides of the cap 1, and preferably any ridges in the cap 1. It is to be appreciated that the so positioned rotation of the housing 12 will increase the torque force of rotation on the bottle cap 1, facilitating opening of the bottle 2 shown in FIG. 4.

In a preferred embodiment, the slider 148 may include a contoured surface 40 which may be actuable from the holding side 14, such as by the index finger of a user. In this way, actuating the slider 148 by the user applying pressure to the surface 40 on the holding side 14 will cause relative movement between the fixed blade 31 and the moveable blade 32 to cause the gripping members 21, 22 to move together sufficiently to engage and grip the first and second portions 1*a*, 1*b* of the bottle cap 1.

The second operational portion 101, as shown best in FIGS. 1 and 3 includes a tab opening element 110. The tab opening element 110 is shown best in FIG. 3 as extending as a generally rectangular slot 112 which extends inwardly in the direction of axis $A–A_1$ from the nose portion 220.

Figure 9:
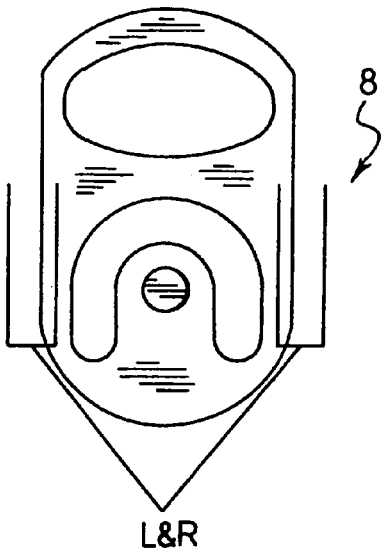
FIG.9. PRIOR ART
FIG. 9 illustrates schematically contact points between the housing with the pull tab of FIG. 7 following seating of the tab within the nosing slot.
Figure 10:
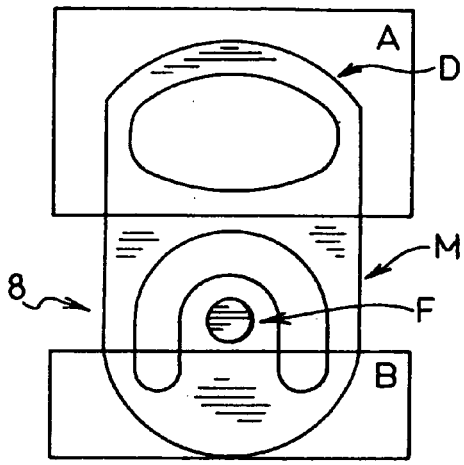
FIG.10. PRIOR ART
FIG. 10 is a diagram illustrating the contact point (A) for conventional prior art pull-tab lifters currently in the market.
Figure 11:
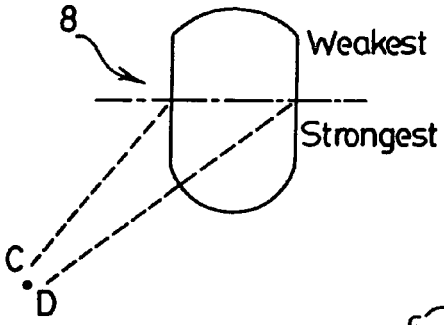
FIG.11. PRIOR ART
FIG. 11 shows a schematic view of a conventional beverage can pull tab, illustrating the common break points (c & d) and strong and weak tab sections.

The slot 112 is formed with a lateral width which is preferably selected as between about 1.5 and 2 cm, and a vertical height of between about 1 and 2 mm so as to facilitate the insertion of a can pull tab 8 therein. A lower surface of the tab opening element 110 is most preferably formed as a generally planar bearing surface 120. As will be described, the bearing surface 120 has a dimensional thickness of preferably about 1 mm. The dimension of the bearing surface 120 enables it to pass underneath the tab 8 of the can 6, as best shown in FIG. 31*a*. The bearing surface 120 can preferably pass underneath the tab 8 of the can 6 to a position between the midpoint M and the fulcrum F of the tab 8. The fulcrum F, the midpoint M, as well as the distal end D of the tab 8 are best shown in FIG. 9. By having the bearing surface dimensioned to pass underneath the tab 8 of the can 6 to a position between the midpoint M and the fulcrum F of the tab 8, force will not be applied to the weakest part of the tab 8 as illustrated in FIG. 11.

Although not essential, FIG. 3 shows best a notch 122 as being formed in the bearing surface 120 adjacent to the axial forwardmost end of the housing 12. The notch 122 is most preferably provided to facilitate removal of any pull tab 8 which may be separated from a can 6 and otherwise trapped within the slot 112.

Figure 12:
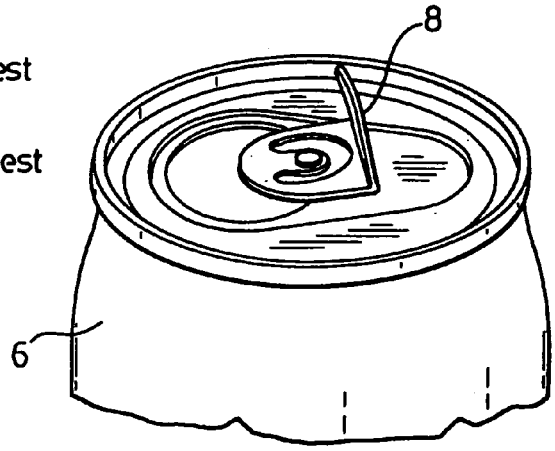
FIG.12. PRIOR ART
FIG. 12 illustrates a conventional beverage can showing a broken pull tab at a breakage point aligned with the break points shown in FIG. 11.
Figure 13A:
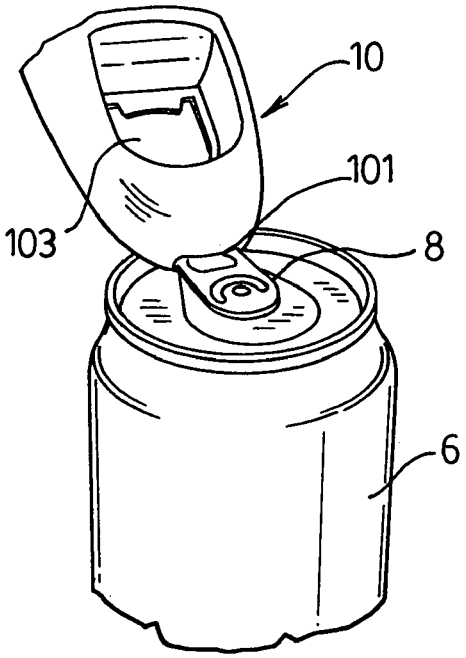
FIGS. 13*a* to 13*d* illustrate schematically the manner of engagement of the pull tab shown in FIG. 7 with the nosing slot of the opener of FIG. 1.
Figure 13B:
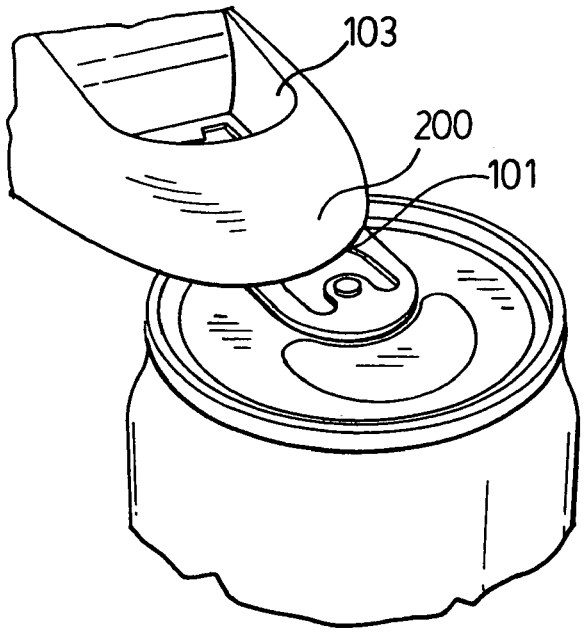
Figure 13C:
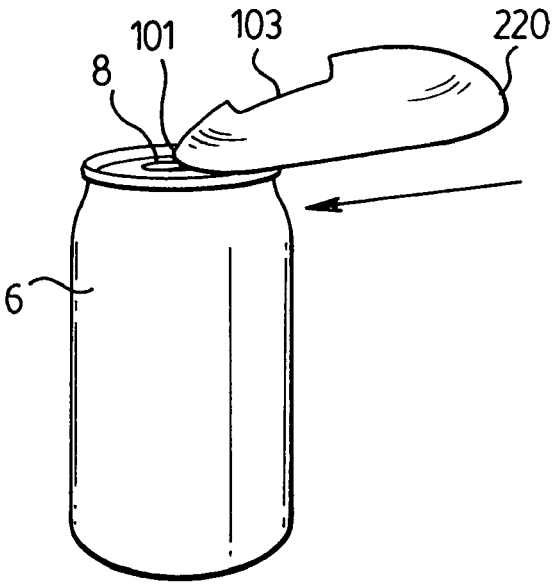
Figure 13D:
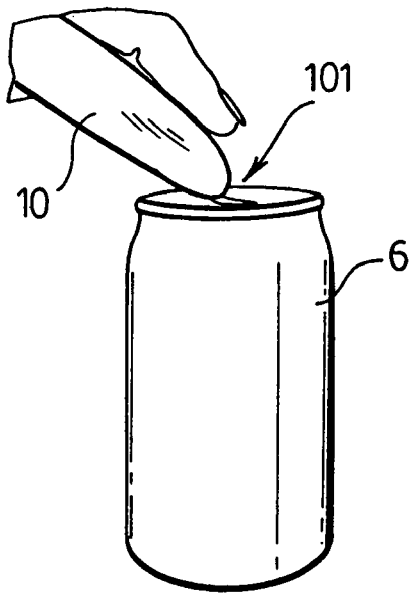

Once the bearing surface 120 has engaged the tab 8, movement of the enlarged portion 220 of the housing 12 away from the can 6, as illustrated in FIGS. 13*a* to 13*d*, will cause the bearing surface 120 to lift the tab 8 at a point between the midpoint M of the tab 8 and the fulcrum F of the tab 8, and apply pressure along the strongest portion of the tab 8 as illustrated in FIG. 12. This will cause the tab 8 to act on the fulcrum F and open the can. It is understood that while FIG. 13*d* shows the housing 12 having been rotated to a substantially 45° position with respect to the can, this need not be the finish point, but rather the finish point may be at any point where the tab 8 has sufficiently opened the can 6 for the user.

In an alternate construction, the tab opening element 110 may also be provided with side guiding elements on either side of the load bearing surface 120 to guide the tab 8 onto the load bearing surface 120. The portion of the housing 12 which defines the tab opening element 110 disposed adjacent to the load bearing surface 120 is robust enough to protect against the tab 8 breaking off while force is being applied by the user lifting the end 220 of the opener 10 upward away from the can 6.

FIGS. 1 and 3 show best the third operational portion 103 of the opener 10. The operational portion 103 is adapted to facilitate the opening of pry cap, or metal crown bottle caps and includes a through opening 300 which extends through the housing 12. A conventional metal pry-type bottle opener 302 is located within the through opening 300. The opener 302 is provided so as to position recessed relative to both the upper and lower side surfaces 14, 15 and includes an axially extending pry tab 310. It is to be appreciated that the rounded tear drop shape of the housing 12 and its overall dimensions enable the opener 10 to be comfortably gripped by the hand of the user, and the opener 302 used to lever off conventional pry top bottle caps with minimal effort.

Although not essential, FIG. 3 shows best the lower surface 15 of the opener 10 as having recessed therein one or more permanent magnets 50. It is to be appreciated that the magnets 50 may advantageously be used in securing the opener 10 to the vertical surface of a refrigerator door, or the like, for ready use.

Figure 6A:
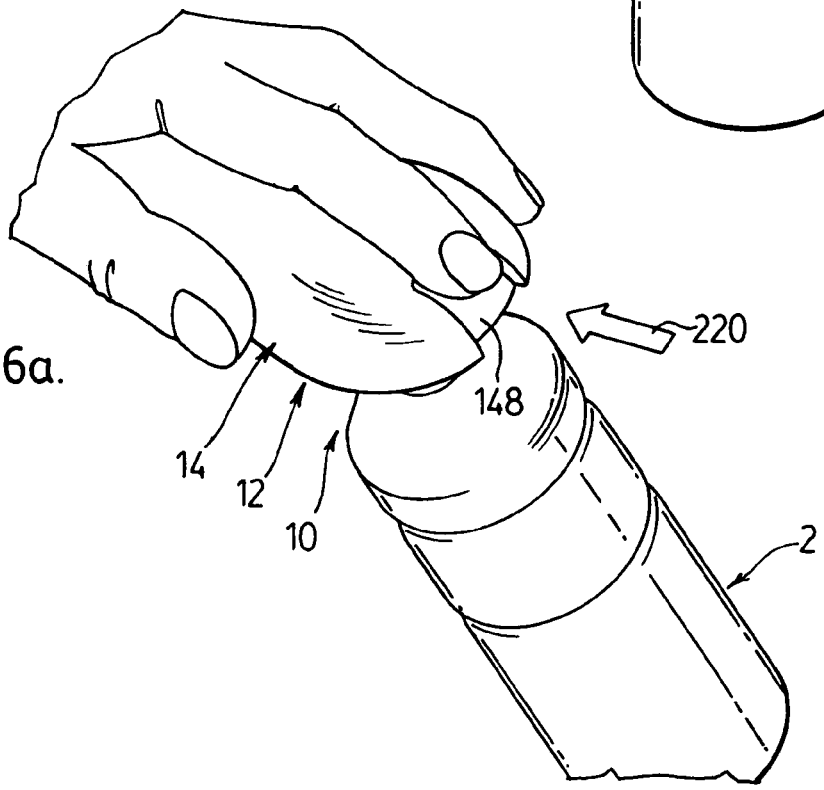
FIGS. 6*a*, 6*b* and 6*c* illustrate enlarged perspective views of the opener of FIG. 1 illustrating the manner of operating a movable gripping members and the rotation of the opener and cap relative to the bottle in counter clockwise and clockwise directions, in the removal and replacement of the bottle cap thereon.
Figure 6B:
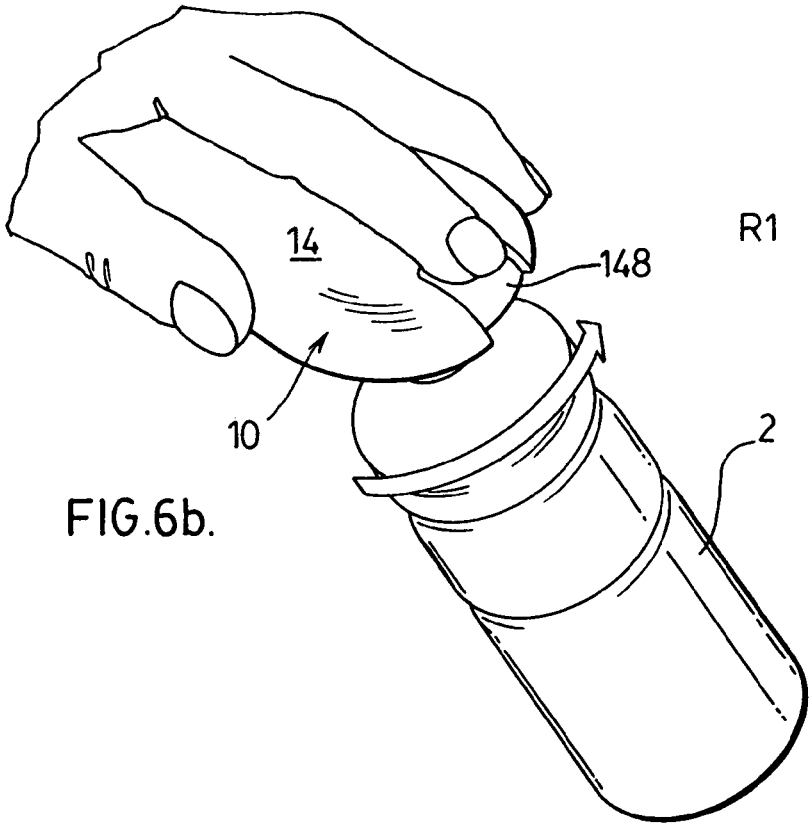
Figure 6C:
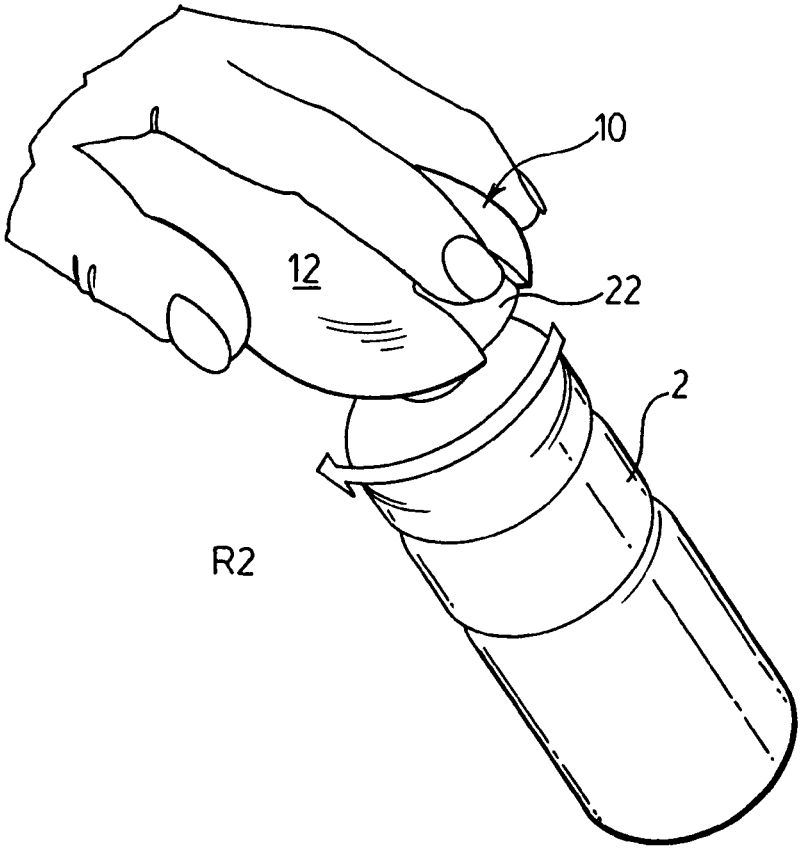
Figure 7:
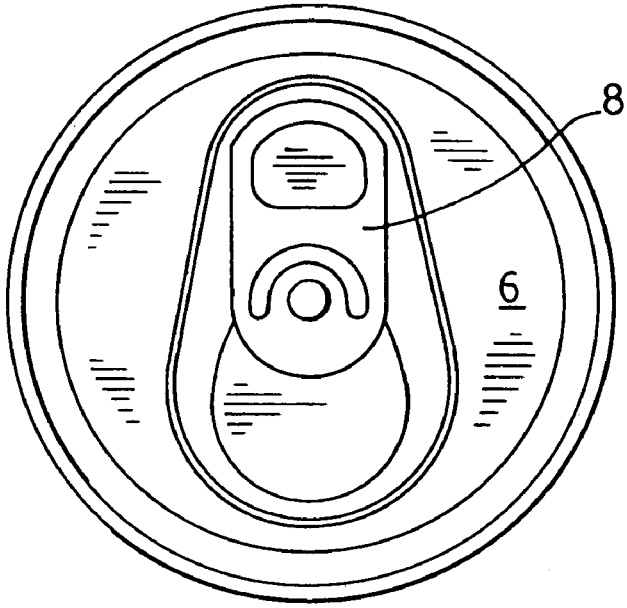
FIG. 7 illustrates a conventional beverage can having a pull-tab type opener.
Figure 8:
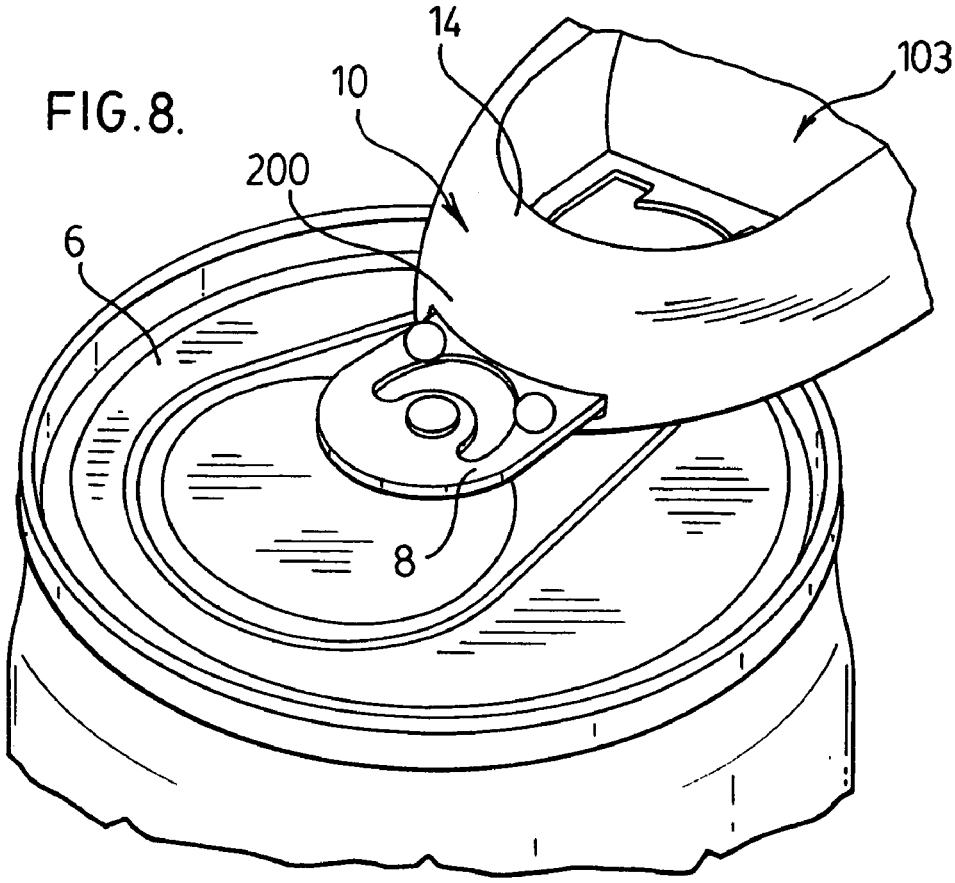
FIG. 8 shows an enlarged perspective view of the engagement of the pull-tab shown in FIG. 7 within a nosing slot formed in the opener of FIG. 1.

The operation of the beverage container opener 10 in the removal of a twist off bottle cap 1 is shown best in FIGS. 6*a*, 6*b* and 6*c*. To remove or loosen a bottle cap 8, the lower surface 15 of the opener 10 is positioned over the cap 1 so that the cap 1 locates within the recess 19 between the gripping members 21, 22. When so positioned, the user uses his index finger to depress the slider 148, moving it along the slot 150 so that the blade 32 moves towards the blade 31 until it comes into secure contact with the sides of the cap 1. With the user maintaining finger pressure on the slider 148 and the bottle 2 held securely by the user's other hand, the opener 10 is twisted in a counter clockwise direction until the cap 1 is loosened.

To replace or tighten a bottle cap, the cap 1 is initially threaded in a finger type manner on the top of the bottle 2. The opener 10 is thereafter positioned over the cap 1 in the identical manner as when loosening the cap 1 and the slider 148 is depressed. While the user's finger maintains pressure contact between the blades 31, 32 and the cap 1, the opener 1 is rotated in a clockwise direction while the user grasps the bottle 2 with his other hand, tightening the cap 1 thereon.

The use of the opener 10 to actuate a pull tab 8 of a beverage can 6 is shown best in FIGS. 13*a* to 13*d*. To actuate the pull tab 8, the end of the tab 8 is slid into the slot 112 formed in the nose portion 200 so as to be engaged by the bearing surface 120. The opener 10 is moved so that the bearing surface 120 assumes a position between the fulcrum F and the mid-portion M of the tab 8. Once so positioned, the enlarged end 220 of the opener 10 is pivoted upwardly away from the can 6 resulting in the pivotal movement of the tab about its fulcrum F.

Figure 14:
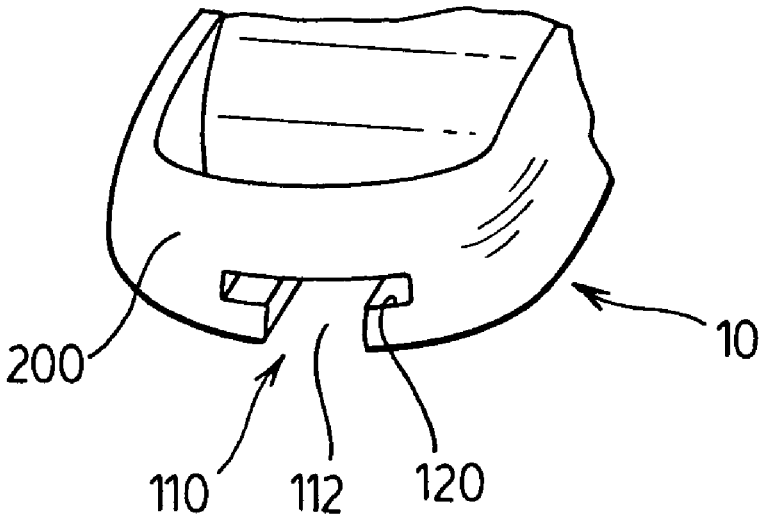
FIG. 14 illustrates schematically the positioning of the pull tab within a nosing slot in accordance with a further embodiment of the invention.

FIG. 14 shows an alternate embodiment of the present invention wherein like reference numerals are used to identify like components. In FIG. 14, the opener 10 is shown with a housing 12 having only one operational portion 101 which is operable to assist in biasing a pull tab 8 of a beverage can 6. It is understood that one or more operational parts 11, 101 or 103 may be used. FIG. 14 shows an additional embodiment of the invention wherein contact on the tab 8 of the can 6 corresponds to the left and right L.R. as illustrated in FIG. 9. It is also understood that the contact points CP will be between the full point and the mid-point of the tab 8, which also correspond in general to the stronger portion of the tab 8 thereby decreasing the likelihood that the tab 8 may break during use of the device 10.

Although FIGS. 1 to 4 describe and illustrate the bearing surface 120 as being a planar flat surface, the invention is not so limited. FIG. 14 illustrates an alternate embodiment of the invention wherein like numerals are used to identify like components. In FIG. 14, the bearing surface 120 is illustrated as having a central gap 125 extending there along generally aligned with the axis $A–A_1$ of the opener housing 12. It is to be appreciated that the presence of a central gap 125 which extends substantially the entire length of the slot 112 advantageously provides still simplified removal of any severed tabs 8 which may become lodged therein. This embodiment is consistent with the left and right LR locations of the tab 8 illustrated in FIG. 9 being in contact with the load bearing surface 120. It is understood that alternate embodiments may be possible. It is also understood that the load bearing surface 120 may be completely filled in for instance for aesthetic reasons or to avoid contact with sharp or jagged ends for safety reasons.

Figure 15:
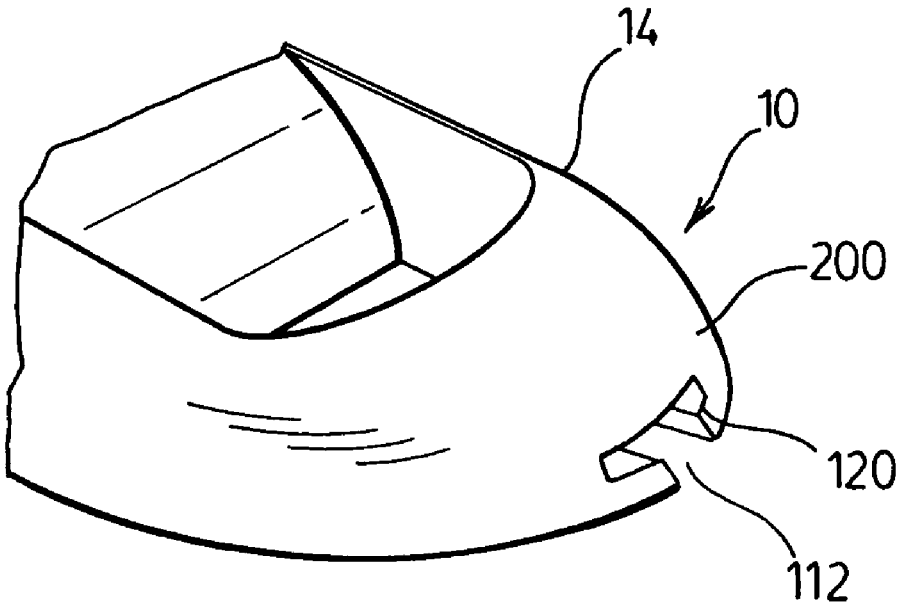
FIG. 15 illustrates schematically a further embodiment of the present invention.

FIG. 15 illustrates further preferred embodiment of the present invention wherein like reference numerals are used to identify like components. As illustrated in FIG. 15, a load bearing surface 120 projects forwardly from the remainder of the nosing end 200 and, also has a partial cut-away mid-region, is used to contact the contact points LR on a tab 8. The contact points are located between the mid point of the tab 8 and the fulcrum F.

As illustrated by FIGS. 14 and 15, it is apparent that the device 10 may optionally have one or more operational parts 11, 101 and 103. Accordingly, it is understood that the present invention is intended to encompass a container opening device having one or more operational parts 11, 101 and 103 including any combination of only two operational parts 11, 101 and 103 and other operational sides not shown. In at least two preferred embodiments, as illustrated in FIGS. 14 and 15, the device 10 will have at least the second operational part 101 for lifting the tab 8 in a can 6 and may have a third operational part 103 for opening bottle caps, but not necessarily the first operational part 11 for facilitating rotation of a bottle cap 1 on a bottle 2.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments, which are functional, electrical or mechanical equivalents of the specific embodiments and features that have been described and illustrated herein.

The invention claimed is:

1. A universal opener for opening twist cap and pull tab beverage containers, said opener comprising, a housing having an upper surface contoured for gripping by a user's hand, and a lower surface, the housing extending in an axial direction from a generally tapered forward end portion to distal rearward end portion, a first operation part being disposed at said forward end portion, the first operation part including, a rearwardly extending slot extending inwardly into said housing a distance of at least about 3 mm, the slot having a lateral dimension selected between about 1 and 3 cm and being sized to engagably receive an end portion of a beverage container pry tab therein, a second operational part being disposed towards said rearward end portion, the second operational part including, a recess formed in said lower surface, a pair of gripping members at least partially disposed in said recess, a first one of said gripping members being fixedly secured to said housing, the second other one of said gripping members being configured for movement relative to said first gripping member between a first position remote from said first gripping member and a second position spaced a distance theretowards, said recess having a dimension selected to receive a portion of a beverage container twist cap therein in a position interposed between said first and second gripping members, when said gripping members are in said first position.

2. The opener as darned in claim 1 wherein said gripping members each include a respective toothed-blade, the blades of said gripping members being positioned for engagement with a peripheral portion of said twist cap when said twist cap is interposed between said gripping members and said second gripping members in said second position.

3. The opener as claimed in claim 1 further including a biasing member for resiliently biasing the second gripping member to the first position.

4. The opener as claimed in claim 1 wherein said housing further includes a slot extending axially therethrough from the distalmost end of the housing towards said forward end portion, the second gripping member further including a tab reciprocally slidably movable along said slot.

5. The opener as claimed in claim 1 further including a through opening formed through said housing intermediate the first operational part and said second operational part, a pry-cap opener being disposed in said though opening and operable to engage a peripheral edge of a crown-type bottle cap for opening pry cap beverage containers.

6. The opener as claimed in claim 1 wherein said housing has a general shape selected from a tear-drop shape and an elliptical shape.

7. The opener as claimed in claim 6 wherein said housing has an overall axial length selected at between about 7 and 13 cm, and a lateral width of between about 3 and 7 cm.

8. The opener as claimed in claim 1 wherein said lower surface comprises a generally planar surface.

9. The opener as claimed in claim 1 wherein said slot is defined in part by a bearing surface dimensioned to pass underneath the tab of a can to a position between a midpoint and a fulcrum of the tab; and wherein the inclined movement of the housing relative to an uppermost surface of the bearing surface with portions of the tab between the tab midpoint and fulcrum.

10. An opener for opening twist cap and pry tab containers, said opener comprising, a housing having an upper surface sized and contoured for gripping by a user's hand, and a lower surface, the housing being elongated in an axial direction and extending from a forward-end portion to distal rearward end portion, a first operation part being disposed towards said forward end portion, the first operation part including, a slot extending rearwardly into said housing and being sized to engagably receive a pivotal end portion of a container pry tab therein, a second operational part being disposed towards said rearward end portion, the second operational part including, a recess formed in said lower surface, a pair of gripping members at least partially disposed in said recess, a first one of said gripping members being coupled to said housing, the second other one of said gripping members being configured for movement relative to said first gripping member between a first position remote from said first gripping member and a second position spaced a distance theretowards, each of said gripping members including a toothed-blade positioned for engagement with a peripheral portion of a twist cap interposed therebetween when said second gripping member is moved to said second position, a biasing member for resiliently biasing the second gripping member to the first position.

11. The opener as claimed in claim 10 wherein said housing further includes a slot extending axially therethrough from the distalmost end portion partway towards said forward end portion, the second gripping member further including a tab reciprocally slidably movable along said slot.

12. The opener as claimed in claim 11 wherein said housing has a general shape selected from a tear-drop shape and an elliptical shape, and the lower surface comprises a generally planar surface.

13. The opener as claimed in claim 12 further including a through opening formed through said housing intermediate the first operational part and said second operational part, a pry-cap opener being disposed in said through opening and being operable to engage a peripheral edge of a crown-type bottle cap for opening pry cap beverage containers.

14. The opener as claimed in claim 13 wherein said housing has a maximum overall axial length selected at between about 7 and 13 cm, and a maximum lateral width of between about 3 and 7 cm.

15. The opener as claimed in claim 10 wherein said slot is defined in part by a bearing surface dimensioned to pass underneath the tab of a can to a position between a midpoint and a fulcrum of the tab; and wherein the inclined movement of the housing relative to an uppermost surface of the bearing surface with portions of the tab between the tab midpoint and fulcrum.

16. A device for opening beverage containers comprising;

a housing having a holding side and a first operational side;

a first gripping member for engaging at least a first portion of a circumference of a bottle cap;

a second gripping member for engaging a second portion of the circumference of the bottle cap, different from the first portion;

relative movement mechanism actuable by the user from the holding side for causing relative movement between the first grip and the second grip to engage the circumference of the bottle cap therebetween, said sliding mechanism having an actuable surface on the holding side of the housing for causing relative movement between the first gripping member and the second gripping member towards each other to frictionally engage a bottle cap therebetween;

wherein the first gripping member includes a blade fixed to the first operational side of the housing and the second gripping member includes a blade fixed to the sliding mechanism which moves relative to the first gripping member blade;

wherein engagement of a user's finger with the actuable surface of the sliding mechanism effects movement of the second gripping member blade towards the first gripping member blade to engage the circumference of a bottle cap placed therebetween;

wherein rotation of the housing while the first grip and the second grip are engaging the first and second portion of the bottle cap, respectively, facilitates rotation of the bottle cap.

17. The device as defined in claim 16 further comprising a tab opening element on a second operational part for engaging and pivoting a pull tab of a can, said tab opening element on a second operational part for engaging and pivoting a pull tab of a can, said tab opening element comprising, a bearing surface dimensioned to pass underneath the tab of a can to a position between a midpoint and a fulcrum of the tab; and wherein the inclined movement of the housing relative to an uppermost surface of the bearing surface with portions of the tab between the tab midpoint and fulcrum.

* * * * *